US005183113A

United States Patent [19]

Leaney et al.

[11] Patent Number: 5,183,113

[45] Date of Patent: Feb. 2, 1993

[54] DOWN-HOLE DECELERATORS

[75] Inventors: Peter A. Leaney; Robert J. Smith, both of Cheltenham, England

[73] Assignee: Baroid Technology, Inc., Houston, Tex.

[21] Appl. No.: 514,424

[22] Filed: Apr. 25, 1990

[30] Foreign Application Priority Data

Apr. 29, 1989 [GB] United Kingdom ..... 8909938

[51] Int. Cl.[5] ..... E21B 17/07; E21B 47/00; F16F 5/00; G01D 11/24

[52] U.S. Cl. ..... 166/316; 73/431; 73/151; 267/125; 175/40

[58] Field of Search ..... 166/250, 64, 65.1, 178, 166/316, 385, 77; 175/40-50, 58-60; 267/125, 126, 127, 129; 73/11, 151, 430, 431

[56] References Cited

U.S. PATENT DOCUMENTS

| | | | |
|---|---|---|---|
| 4,223,746 | 9/1980 | Tanguy et al. | 175/45 X |
| 4,413,516 | 11/1983 | Croom, Jr. et al. | 73/431 |
| 4,597,440 | 7/1986 | Pottier | 166/250 |
| 4,679,669 | 7/1987 | Kalb et al. | 73/151 X |
| 4,693,317 | 9/1987 | Edwards et al. | 166/378 |
| 4,932,471 | 6/1990 | Tucker et al. | 166/64 |
| 4,979,563 | 12/1990 | Patel | 166/250 |

*Primary Examiner*—Stephen J. Novosad
*Attorney, Agent, or Firm*—Browning, Bushman, Anderson & Brookhart

[57] ABSTRACT

A down-hole decelerator for decelerating a device dropped down a borehole in a drilling mud column has an elongate casing immersible in the mud flow with its longitudinal axis along the axis of the borehole. A plunger is slidable axially within the casing to vary the volume of two chambers within the casing and terminates outside the casing in a nose for impacting on a landing plate within the borehole when the decelerator reaches the end of its travel on being dropped down the borehole. Apertures extend through the wall of the casing between the chambers and the outside of the casing so that, when the casing is initially immersed in the mud column on being dropped down the borehole, mud flows into the chambers through an apertures, and, when the nose impacts on the landing plate within the borehole, the plunger is forced inwardly of the casing to decrease the volume of the chambers and deceleration of the device takes place by virtue of the resulting controlled flow of mud out of the chambers through the apertures. The device is thereby efficiently safeguarded against damage by impact with the landing plate.

17 Claims, 1 Drawing Sheet

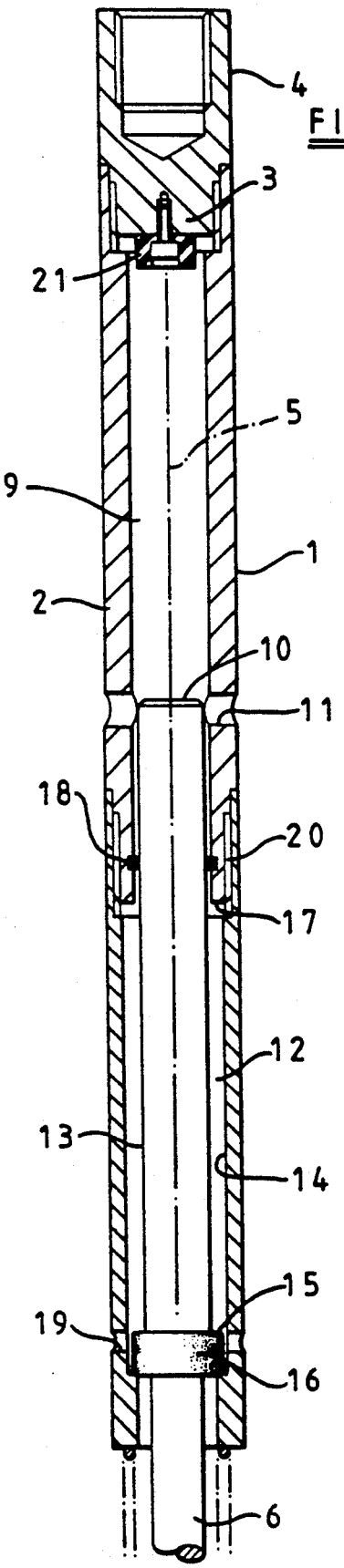
FIG 1
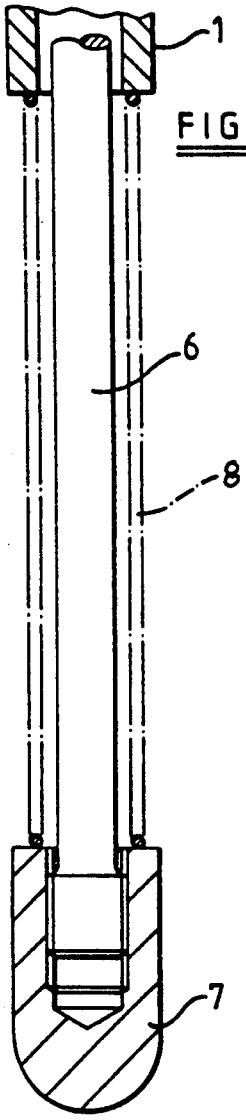
FIG 2
FIG 3
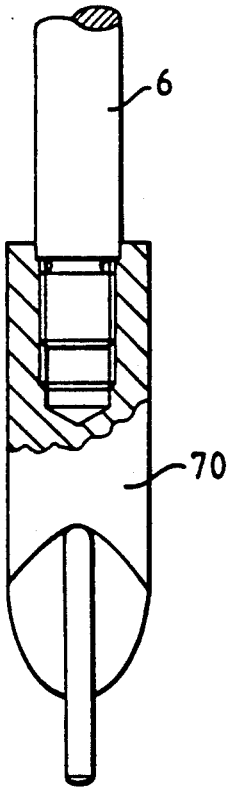

DOWN-HOLE DECELERATORS

BACKGROUND OF THE INVENTION

This invention relates to down-hole decelerators for decelerating a device dropped down a borehole in a drilling mud column.

It is conventional practice to drop measuring instrumentation and other devices down the inside of a hollow drill string filled with drilling mud in order to locate the instrumentation at a position down-hole in the vicinity of the drill bit. Examples of tools which are commonly introduced into the borehole in this manner are electronic single-shot and multi-shot tools and coring tools.

Furthermore it is usual for the drill string to incorporate a landing plate to receive the tool at its intended location within the drill string. It will be appreciated that measuring instrumentation dropped down the borehole in this manner will experience a high impact load on contacting the landing plate, and this may result in damage to the measuring instrumentation and possible loss of drilling time in the event that the measuring instrument requires replacement.

Accordingly it has long been the practice for a tool which is to be dropped down-hole to be provided with a form of decelerator which is commonly referred to in the art as a stinger. Such a decelerator comprises a plunger having a nose for contacting the landing plate, and a stiff spring surrounding the plunger and located between the nose and a sleeve within which the plunger is slidable. When the nose contacts the landing plate, the plunger is displaced against the action of the spring, and accordingly the spring cushions the impact to some extent. However, a decelerator of this form is extremely inefficient, and does not provide an adequate safeguard against damage to measuring instrumentation dropped downhole.

It is an object of the invention to provide a novel form of down-hole decelerator which is considerably more efficient than this prior form of decelerator.

SUMMARY OF THE INVENTION

According to the present invention there is provided a down-hole decelerator for decelerating a device dropped down a borehole in a drilling mud column, the decelerator comprising an elongate casing immersible in the mud flow and having a longitudinal axis intended to lie along the axis of the borehole in use, a plunger slidable axially within the casing to vary the volume of a chamber within the casing and terminating outside the casing in a nose for contacting a landing plate within the borehole, wherein mud flow passage means extends through the wall of the casing between the chamber and the outside of the casing so that, in use, when the casing is initially immersed in the mud column, mud flows into the chamber through the passage means and, when the nose contacts the landing plate within the borehole, the plunger is forced inwardly of the casing to decrease the volume of the chamber and deceleration of the device takes place by virtue of the resulting controlled flow of mud out of the chamber through the passage means.

Such an arrangement is capable of providing controlled deceleration of the device in such a manner that the device is adequately safeguarded against damage by impact with the landing plate.

In a preferred embodiment of the invention a compression spring surrounds the plunger between the nose and the casing so as to bias the plunger outwardly of the casing. Such a spring ensures that the plunger is not forced inwardly of the casing to any substantial extent by the pressure of the mud acting on the nose as the device drops down the borehole.

The arrangement may be such that, as the plunger is moved inwardly of the casing on impact with the landing plate, the throughflow cross-section for flow of mud out of the chamber decreases. To this end the passage means may include a series of apertures spaced along the casing such that the apertures are successively covered as the plunger is moved inwardly of the casing.

Additionally or alternatively the arrangement may be such that, as the plunger is moved inwardly of the casing on impact with the landing plate, the length of the flow path for flow of mud from the chamber to the outside of the casing increases. To this end the passage means may include one or more apertures which open into an annular gap between an outer surface of the plunger and an inner surface of the casing such that, the axial length of the gap between the chamber and the or each aperture increases as the plunger is moved inwardly of the casing. In this manner the frictional resistance to flow of mud out of the chamber is increased as the plunger is forced inwardly of the casing.

Furthermore a seal is preferably provided between the plunger and the surrounding wall of the casing to prevent leakage by way of the end of the casing through which the plunger extends.

Conveniently the chamber extends axially within the casing away from the plunger between the end of the plunger and an end wall of the casing. However, the chamber may be formed by an annular space between an outer surface of the plunger and an inner surface of the casing and extending axially between a shoulder on the plunger and a narrowing of the casing. In certain circumstances it may be advantageous for the arrangement to include a chamber of each type and respective mud flow passage means associated with each chamber.

The plunger may be maintained at a fixed orientation within the casing by means of a splined connection, where required. Furthermore an elastomeric bumper may be attached to an end wall within the casing to act as an end stop for the plunger.

BRIEF DESCRIPTION OF THE DRAWINGS

In order that the invention may be more fully understood, a preferred embodiment of down-hole decelerator in accordance with the invention will now be described, by way of example, with reference to the accompanying drawing, in which:

FIG. 1 is an axial section through an upper portion of the decelerator;

FIG. 2 is an axial section through a lower portion of the decelerator; and

FIG. 3 is an axial section through an alternative nose assembly for the decelerator.

DETAILED DESCRIPTION OF THE DRAWINGS

Referring to FIGS. 1 and 2, the decelerator comprises an elongate casing 1 formed by a sleeve 2 and an end wall 3 constituting part of a screwthreaded connector 4 for attaching the decelerator to the bottom of a measurement sonde (not shown). The casing 1 has a longitudinal axis 5 which extends along the axis of the borehole in use.

Furthermore the decelerator includes a plunger 6 slidable axially within the casing 1 and terminating outside the casing 1 in a nose 7 which is a screw fit on the plunger 6. The nose 7 is provided for contacting a landing plate (not shown) which is provided within the drill string in the vicinity of the drill bit and which is of conventional form. A compression spring 8 surrounds the plunger 6 between the nose 7 and the casing 1.

A first chamber 9 is defined within the casing 1 between an end surface 10 of the plunger 6 and the end wall 3. Two or more apertures 11 extend through the wall of the casing 1 between the first chamber 9 and the outside of the casing 1 and are spaced about an annulus. A second chamber 12 is formed by an annular space between an outer surface 13 of the plunger 6 and an inner surface 14 of the casing 1. The second chamber 12 extends axially between a shoulder 15 provided by a cushion part 16 of the plunger 6 and a shoulder 17 constituting a narrowing of the inside diameter of the casing 1. A series of apertures 19 extends through the wall of the casing 1 between the second chamber 12 and the outside of the casing 1, the apertures 19 being spaced about an annulus.

An annular seal 18 surrounds the plunger 6 intermediate the chambers 9 and 12. It will be appreciated from FIG. 1 that, for ease of fabrication, the sleeve 2 of the casing 1 is formed in two parts which are connected together by a screw connection 20. Furthermore a rubber bumper 21 is attached to the end wall 3 within the casing 1 to act as an end stop for the plunger 6. Although not specifically apparent from the drawing, splines are also provided on the plunger 6 for engagement with corresponding grooves on the inside wall of the casing 1 to prevent turning of the plunger 6 about the axis 5 of the casing 1.

In operation of the decelerator when it is dropped down a borehole within the mud column in a drill string, together with the measurement sonde to which it is attached, the plunger 6 is initially biased outwardly of the casing 1 into the position shown in FIGS. 1 and 2. In this position mud may flow freely into the chambers 9 and 12 from the outside of the casing 1 through the apertures 11 and 19. This ensures that the chambers 9 and 12 are initially filled with mud. If necessary one or more valves may be provided in the wall of the casing 1 to enable air to be purged from the chambers 9 and 12. As the decelerator and the attached measurement sonde travel down the borehole they will reach terminal velocity, and the nose 7 will accordingly contact the landing plate at high impact pressure. This will cause the plunger 6 to be forced inwardly of the casing 1 to decrease the volumes of the chambers 9 and 12, and this will result in flow of mud out of the chambers 9 and 12 through the apertures 11 and 19. Furthermore, as the plunger 6 is moved inwardly of the casing 1, the length of the flow path for flow of mud from each of the chambers 9 and 12 to the outside of the casing increases. In the case of the flow of mud out of the chamber 9, the flow occurs by way of an annular gap surrounding the end of the plunger towards the apertures 11, the axial length of this gap increasing as the plunger 6 is moved inwardly of the casing 1. In the case of the flow of mud out of the chamber 12, the flow takes place by way of an annular gap surrounding the cushion part 16 (and also a part of the plunger 6 below the cushion part 16) towards the apertures 19, the axial length of this gap increasing as the plunger 6 is moved inwardly of the casing 1. The resulting frictional resistance to the flow of mud through the annular gaps and the apertures 11 and 19 on movement of the plunger 6 provides controlled deceleration of the sonde.

It is found in practice that separate contributions are made to the decelerating force by the action of the spring 8, the action of the mud flowing out of the chamber 12 and the action of the mud flowing out of the chamber 9. Furthermore the relative magnitudes of these contributions vary with time, that is with the extent to which the plunger 6 has been moved inwardly of the casing 1 following contact of the nose 7 with the landing plate. It will be appreciated that the particular profile of the decelerating force applied with respect to time may be varied by varying such parameters as the diameters of the apertures 11 and 19 and the width of the annular gaps surrounding the plunger 6 through which mud flows towards the apertures 11 and 19. If desired, the relevant parameters may be chosen so as to provide an overall linear response. The response may also be varied by providing a series of apertures spaced along the casing such that the apertures are successively covered as the plunger 6 is moved inwardly of the casing 1, and, if required, these apertures may be made of various sizes. Furthermore, if appropriate for a particular application, the response of the decelerator may be changed on site by closing off, or changing the diameter of, one or more apertures by inserting a screwthreaded insert into the aperture.

The above-described decelerator is particularly advantageous due to the fact that it controls the deceleration of the sonde in such a way that the forces acting on the internal instrumentation of the sonde are minimised, and damage of the instrumentation by impact is substantially avoided. Furthermore the efficiency of the decelerator is such that, in many cases, it is possible to drop the assembly down-hole without stopping the pumping of mud down the drill string.

In a development of the invention, which is particularly applicable to use of the decelerator for decelerating a sonde dropped down-hole for steering or coring applications, where the orientation of the sonde with respect to the drill string in its final position is important, the nose 7 is replaced by a mule shoe connector 70 of per se known form, as shown in FIG. 3. The mule shoe connector 70 is adapted to contact a mule shoe landing plate in order to orient the sonde with respect to the landing plate in a manner which is known per se so that the sonde becomes fixed in a predetermined orientation with respect to the drill string.

We claim:

1. A down-hole decelerator for decelerating a device passed through a borehole, the decelerator comprising an elongate telescopic assembly having a longitudinal axis aligned with the axis of the borehole, the assembly comprising an elongate casing and a plunger slidable axially within the casing, the casing having one or more fluid passage openings through a wall of the casing, the casing and plunger defining a fluid storage chamber between an end of the plunger and an interior wall surface of the casing axially spaced from the plunger such that the axial length of the fluid storage chamber is decreased by the plunger moving inwardly of the casing, the plunger and casing further defining a fluid flow passage therebetween and extending from the fluid storage chamber to the one or more fluid passage openings for fluid flow out of the fluid storage chamber as the plunger moves inwardly of the casing, the fluid flow passage forming a substantially annular gap between the plunger and the interior wall surface of the casing, whereby the axial length of the substantially annular gap increases as the plunger moves inwardly of the casing to decelerate the device as a function of increased resistance to fluid flow through the axially increasing annular gap and then out the one or more fluid passage openings.

2. A decelerator as defined in claim 1, wherein the one or more fluid passage openings through the wall of the casing comprises a plurality of apertures through the wall of the casing, the plurality of apertures being circumferentially arranged about the casing.

3. A decelerator as defined in claim 1, wherein the fluid storage chamber is axially spaced between an upper end surface of the plunger and an upper end wall of the casing.

4. A decelerator as defined in claim 1, further comprising:

a shoulder fixed to the plunger, another fluid storage chamber spaced radially between an outer surface of the plunger and an inner surface of the casing, the another fluid storage chamber having an annular cross-section and extending axially between the shoulder on the plunger and the annular gap, and the casing including another flow passage opening therethrough for fluid flow out of the another chamber as the plunger moves inwardly of the casing.

5. A decelerator as defined in claim 4, wherein the casing and an exterior surface of the plunger spaced axially opposite the another fluid storage chamber with respect to the shoulder define another annular gap for fluid flow from the another chamber to the another flow passage opening, whereby the axial length of the another annular gap increases as the plunger moves inward of the casing to decelerate the device as a function of increased resistance to fluid flow through the axially increasing another annular gap.

6. A decelerator as defined in claim 1, further comprising:

a compression spring for biasing the plunger in a direction outwardly of the casing.

7. A decelerator as defined in claim 1, further comprising a seal between the plunger and the wall of the casing to prevent fluid from leaking out the fluid storage chamber from between the plunger and the casing.

8. A decelerator as defined in claim 1, further comprising:

an elastomeric bumper secured to an end wall within the casing to limit axial travel of the plunger.

9. A decelerator as defined in claim 1, further comprising:

a nose member for impacting a landing plate within the borehole when the decelerator reaches the end of its travel within the borehole.

10. A down-hole decelerator for decelerating a device dropped through a borehole in a drilling mud column, the decelerator comprising an elongate telescopic assembly immersible in the mud column and having a longitudinal axis aligned with the axis of the borehole, the assembly comprising an elongate casing, a plunger slidable axially within the casing, and a nose for impacting on a landing plate within the borehole when the decelerator reaches the end of its travel, the casing having one or more fluid passage openings through a wall of the casing, the casing and plunger defining a mud storage chamber for receiving mud when the decelerator is immersed in the mud column, the plunger and casing further defining a mud flow passage therebetween and extending from the mud storage chamber to the one or more fluid passage openings for mud flow out of the mud storage chamber as the plunger moves inwardly of the casing, the mud flow passage forming a substantially annular gap between at least a portion of the plunger and an interior wall surface of the casing, whereby the axial length of said substantially annular gap increases as the plunger moves inwardly of the casing to decelerate the device as a function of increased resistance to mud flow through the axially increasing annular gap and then out the one or more fluid passage openings.

11. A decelerator as defined in claim 10, wherein the one or more fluid passage openings through the wall of the casing comprises a plurality of apertures through the wall of the casing, the plurality of apertures being circumferentially arranged about the casing.

12. A decelerator as defined in claim 10, wherein the mud storage chamber is axially spaced between an upper end surface of the plunger and an upper end wall of the casing.

13. A decelerator as defined in claim 12, further comprising:

a shoulder fixed to the plunger, another mud storage chamber spaced radially between an outer surface of the plunger and an inner surface of the casing, the another mud storage chamber having an annular cross-section and extending axially between the shoulder on the plunger and the annular gap, and the casing including another flow passage opening therethrough for mud flow out of the another chamber as the plunger moves inwardly of the casing.

14. A decelerator as defined in claim 13, wherein the casing and an exterior surface of the plunger spaced axially opposite the another mud storage chamber with respect to the shoulder define another annular gap for mud flow from the another chamber to the another flow passage opening, whereby the axial length of the another annular gap increases as the plunger moves inward of the casing to decelerate the device as a function of increased resistance to mud flow through axially increasing another annular gap.

15. A decelerator as defined in claim 10, further comprising:

a shoulder fixed to the plunger, the mud storage chamber being spaced axially between an outer surface of the plunger and an inner surface of the casing and having an annular cross-section.

16. A decelerator as defined in claim 10, further comprising:

a compression spring for biasing the plunger in a direction outwardly of the casing.

17. A decelerator as defined in claim 10, further comprising:

a seal between the plunger and the wall of the casing to prevent fluid form leaking out the mud storage chamber from between the plunger and the casing.

* * * * *